US006405842B1

(12) United States Patent
Tsai

(10) Patent No.: US 6,405,842 B1
(45) Date of Patent: Jun. 18, 2002

(54) EXTENDABLE AID STANDING FOR A LUGGAGE

(76) Inventor: James Tsai, No. 103, Ta-Ming 1 Rd., Tung Pao Village, Tan Tzu Hsian, Taichung Hsien (TW)

( * ) Notice: Subject to any disclaimer, the term of this patent is extended or adjusted under 35 U.S.C. 154(b) by 0 days.

(21) Appl. No.: 09/767,713

(22) Filed: Jan. 24, 2001

(51) Int. Cl.[7] ..... A45C 5/00
(52) U.S. Cl. ..... 190/18 R
(58) Field of Search ..... 190/18 R, 18 A; 280/47.315, 47.371, 37, 655, 652

(56) References Cited

U.S. PATENT DOCUMENTS 4,311,222 A * 1/1982 Castanier ..... 190/18 A
4,575,109 A * 3/1986 Codery ..... 190/18 A X
4,773,123 A * 9/1988 Yu ..... 190/18 A X
4,915,402 A * 4/1990 Brinker ..... 190/18 A X
5,044,476 A * 9/1991 Seynhaeve ..... 190/18 A
5,230,408 A * 7/1993 Sadow ..... 190/18 A
5,379,870 A * 1/1995 Sadow ..... 190/18 A
5,524,920 A * 6/1996 Tsai ..... 280/652
5,758,752 A * 6/1998 King et al. ..... 190/18 A
5,873,145 A * 2/1999 Chou ..... 190/18 A X

* cited by examiner

*Primary Examiner*—Lee Young
*Assistant Examiner*—Tri M. Mai
(74) *Attorney, Agent, or Firm*—Browdy and Neimark, P.L.L.C.

(57) ABSTRACT

An extendable aid standing for a luggage comprises a main member, fixed at the bottom end of a luggage. Two rotated members, having two helical guiding slots, pivoted at the lateral ends of the main member for turning between a collapsed position and an extended position. Two pressed members received in two coupled bushings respectively and with two pins insert into the corresponded the pressed members and the coupled bushings. Two elastic means received in the coupled bushings respectively, with one end against at the coupled bushing and the other end against at the pressed member. The coupled bushing, with the pressed members and the elastic means, received in the bottom end of the main member, and let the two ends of the pin received in the guiding slots of the rotated member respectively. The pressed can shift between an unpressed position and a pressed position, by the mean time of shifting, the rotated members are driven to turn to the collapsed position and the extended position to prevent tipped the luggage forwards.

11 Claims, 7 Drawing Sheets

EXTENDABLE AID STANDING FOR A LUGGAGE

FIELD OF THE INVENTION

The present invention is generally relative to a luggage, and more particularly to an automatic extending and collapsing aid standing for a luggage.

BACKGROUND OF THE INVENTION

In the field of conventional luggage, there is a kind of design of luggage, which can expense the volume of the luggage. After expensing the luggage, or putting an extra article on the luggage, the location of the center of gravity of-the luggage will different from the location of the original design, which cause the possibility of tipping the luggage forwards. Conventional solution for above problem is provided an extendable aid standing at the bottom end of the luggage. Please refer to FIG. 1, the luggage 80 provided a standing seat 81 at the front side of the bottom end of the luggage 80. An expandable aid standing 82 pivoted at the seat 81, which can pull out and push into the seat 81 by hand. If there is a dangerous of tipping the luggage 80 forwards, user can pull out the aid standing 82 by hand for increasing the distance between the standing 82 and the wheels 83 of the luggage 80, i.e. increasing the area for supporting the luggage 80, to prevent tipping the luggage 80 forwards. The structure of above aid standing 82 is operated by hand which provided an inconvenient using solution to users.

SUMMARY OF THE INVENTION

The primary objective of the present invention is to provide an extendable aid standing which can automatic extending the aid standing while there is a dangerous of tipping the luggage forwards.

In keeping with the principle of the present invention, the foregoing objective of present invention is attained an expandable aid standing, which comprises a main member, fixing at the bottom end of a luggage; a rotated member, which with on end pivoted at the main member for turning within a predetermined range; a pressed member, which with one end pivoted at the bottom end of the main member for moving inwards to or outwards from the main member, and when the pressed member moved, it will drive the rotated member to turn; and a elastic means, which with one end against at the main member, the other end against at the pressed member, whereby actuating the presses member to move outwards from the main member for driving the rotated member to turn inwards to the luggage; and while a pressure exerted on the pressed to overcome the elastic means, the pressed member will move inwards to the main member and drives the rotated to rotate an angle to orient to the front side of the luggage for preventing tipping.

DETAIL DESCRIPTION OF THE INVENTION

Figure 1:
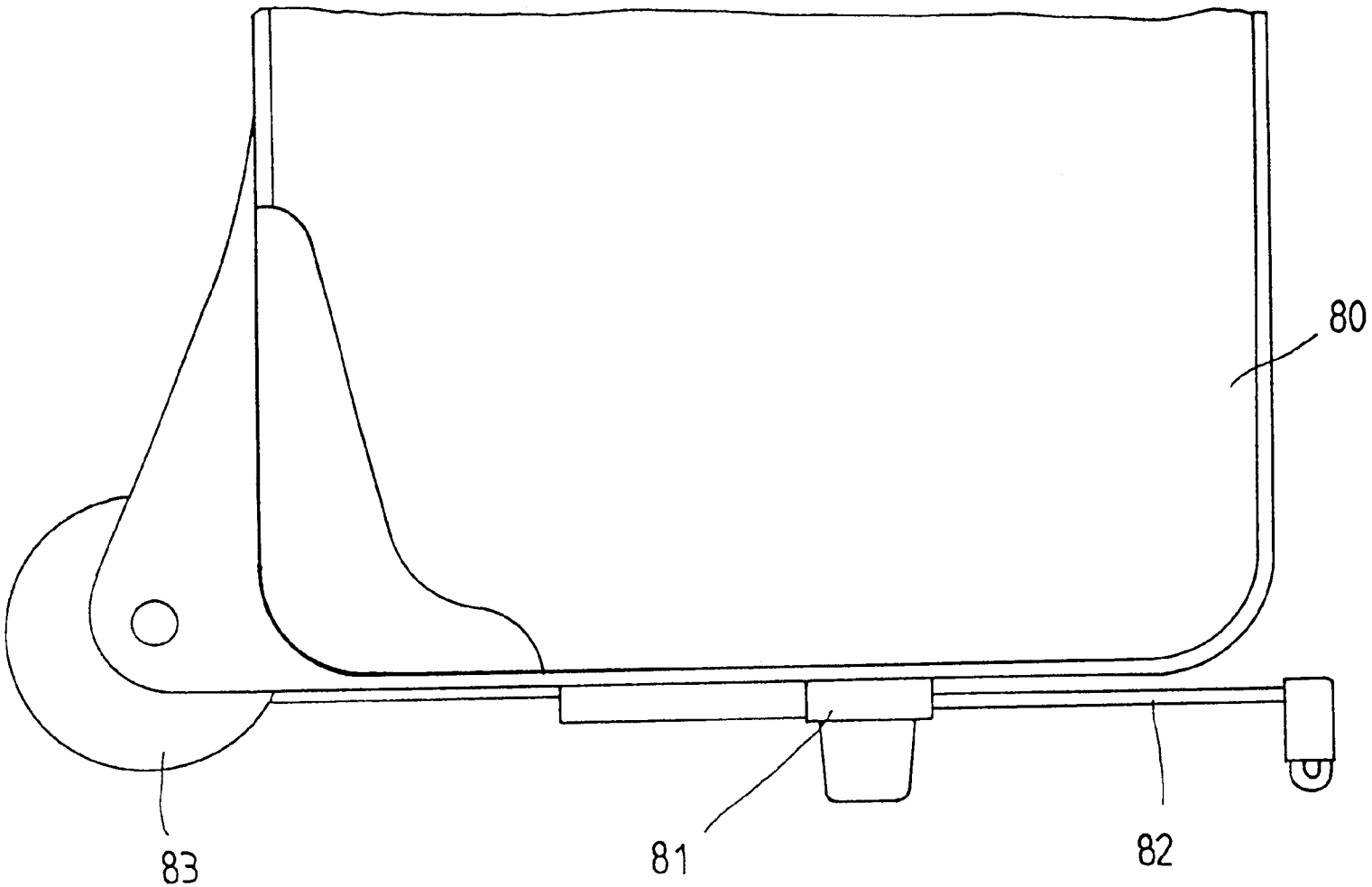
FIG. 1 PRIOR ART
FIG. 1 is a schematic view of a prior art extendable aid standing of a luggage.
Figure 2:
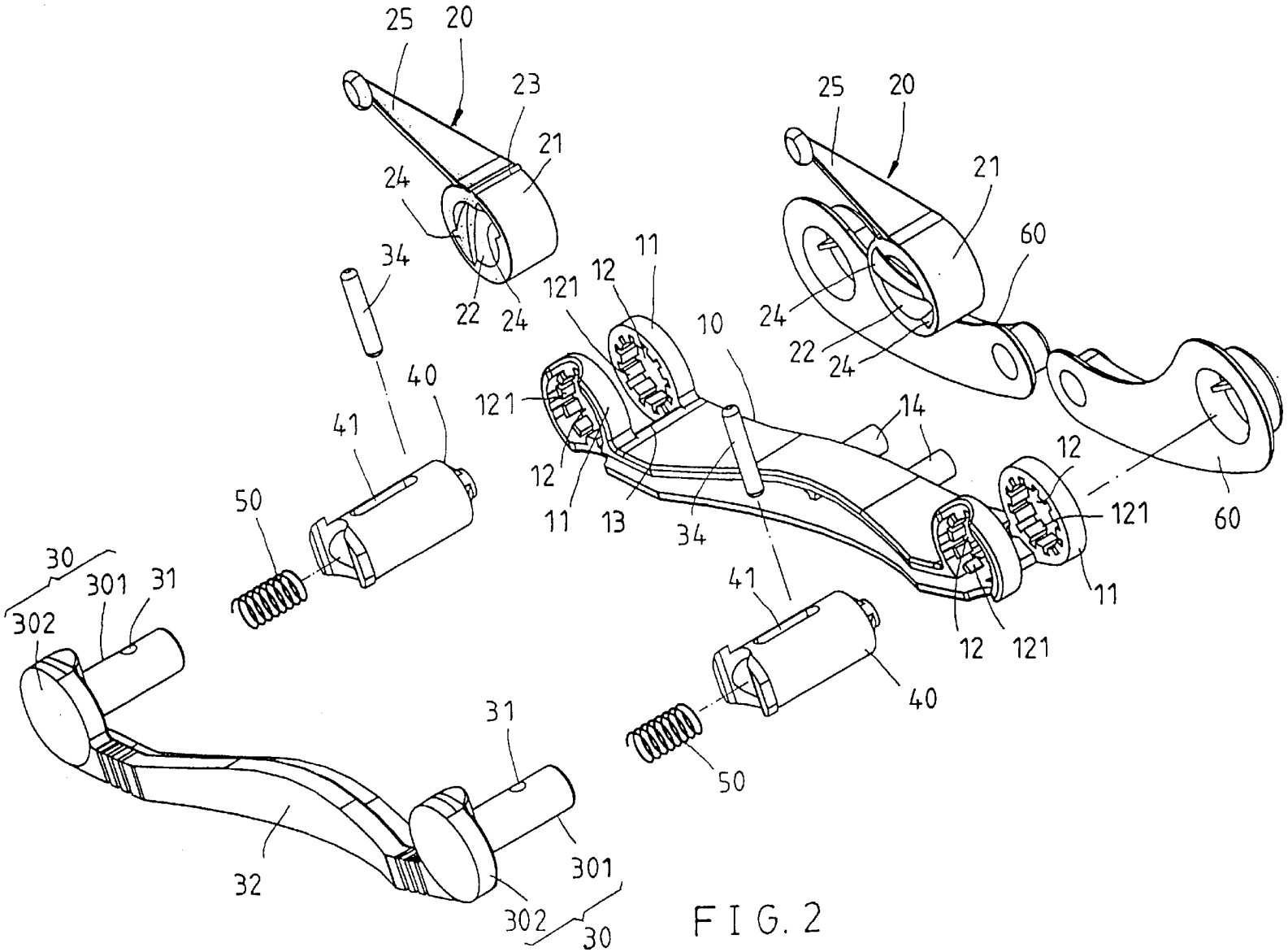
FIG. 2 is an exploded view of the present invention.
Figure 3:
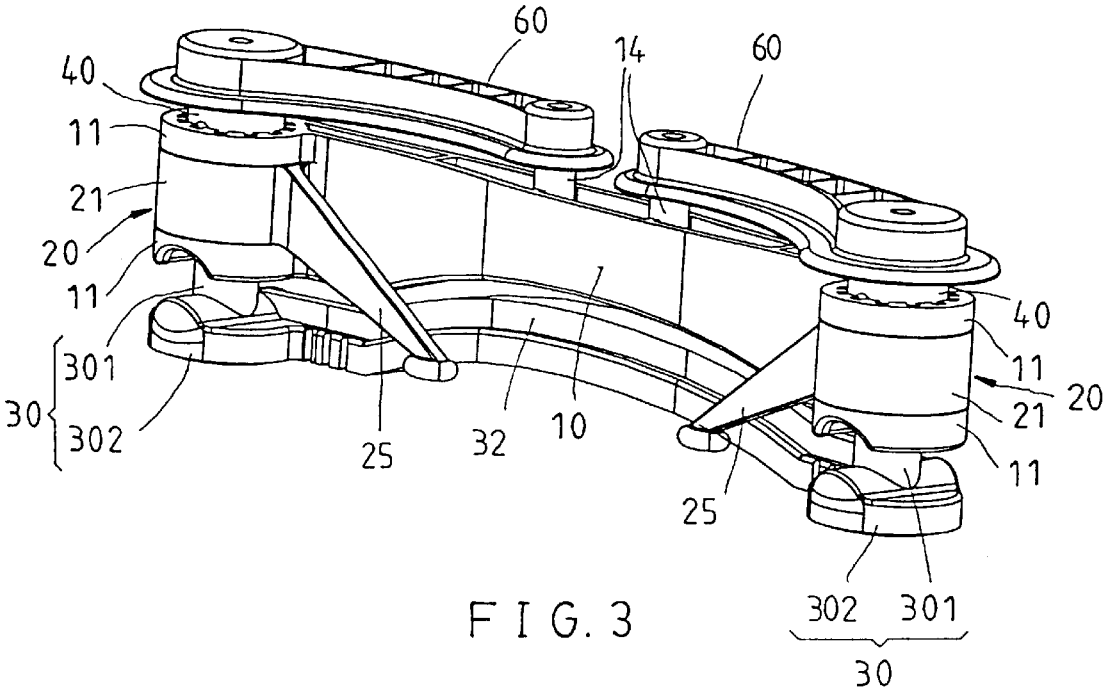
FIG. 3 is a perspective view of the present invention (in collapsed state).
Figure 4:
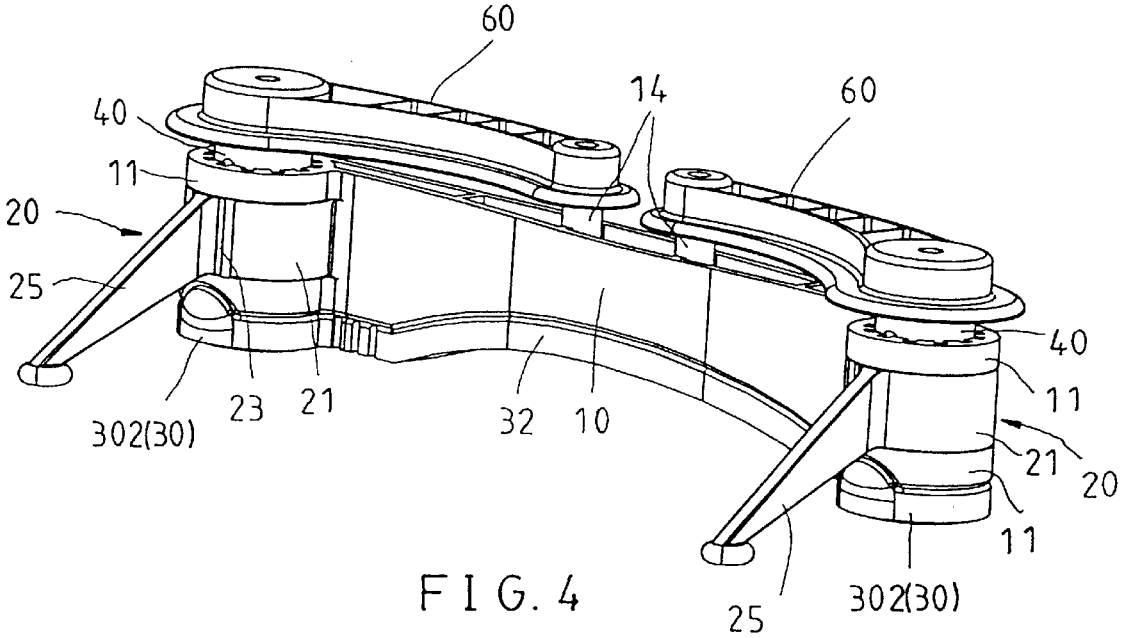
FIG. 4 is a perspective view of the present invention (in extended state).

As shown in FIG. 2 to 4, a extendable aid standing embodied in the present invention is comprising a main member 10, two rotated members 20, two pressed members 30, two coupled bushings 40, two elastic means 50 and two mounts 60; wherein The main member 10 is made by plastic and elongated in transverse direction. Two receiving pieces 11 provided at the top and bottom side of the two transverse ends of the main member 10 respectively. Each of the receiving pieces 11 has a hole 12 and a teeth potion 121 at the inner surface of each hole 12 of the receiving pieces 11. Two locking ribs 13 provided at close to the two ends of the main member 10 and between the two receiving pieces 11 on the same side respectively. Two posts 14 provided at the top end of the main member 10.

Each of the rotated members 20 has a pivoted potion 21 and a arm 25. The pivoted potions 21 of the rotated members 20 each is a cylinder with a receiving hole 22. The pivoted potion 21 of each rotated members 20 has a rib 23 on the outer surface and has two helical guiding slots 24 on the inner surface of the receiving hole 22. The arm 25 with one end connected at the pivoted potions 21 of the rotated members 20 respectively, and elongated outwards and downwards. The rotated members 20 pivoted at the two ends of the main member 10 with the pivoted potion 21 of each rotated member 20 received in between the receiving piece 11 on the same side respectively. The receiving holes 22 of the rotated members 20 corresponding to the holes 12 of the two receiving pieces 11 on the same side of the main member 10 respectively. Thus, the two rotated members 20 can rotate at a predetermined range.

Each of the pressed members 30 has a bottom potion 301, which has a larger diameter, and a cylinder potion 302, which fixed at the top end of the bottom potion 301 and has a smaller diameter. Each cylinder potions 302 of the pressed members 30 has a hole 31 along diametric direction. A bar 32 with two ends connected to the bottom potions 301 of the pressed members 30 to let the two. pressed members 30 as a unit.

The coupled bushings 40 are opening at the bottoms and have a screw hole 42 at top end. Two guiding holes 41 disposed at the opposite sides of the coupled bushings 40 elongated along the axial of the coupled bushings 40 respectively. The cylinder potions 302 of the pressed members 30 received in the coupled bushings 40, and the holes 31 of the pressed members 30 are corresponding to the guiding holes 41 of the coupled bushings 40 respectively. Two pin 34 inserted into the holes 31 of the pressed members 30 and the guiding holes 41 of the coupled bushings 40 respectively, whereby the pressed members 30 can displace along the guiding holes 41 of the coupled bushings 40.

Figure 5:
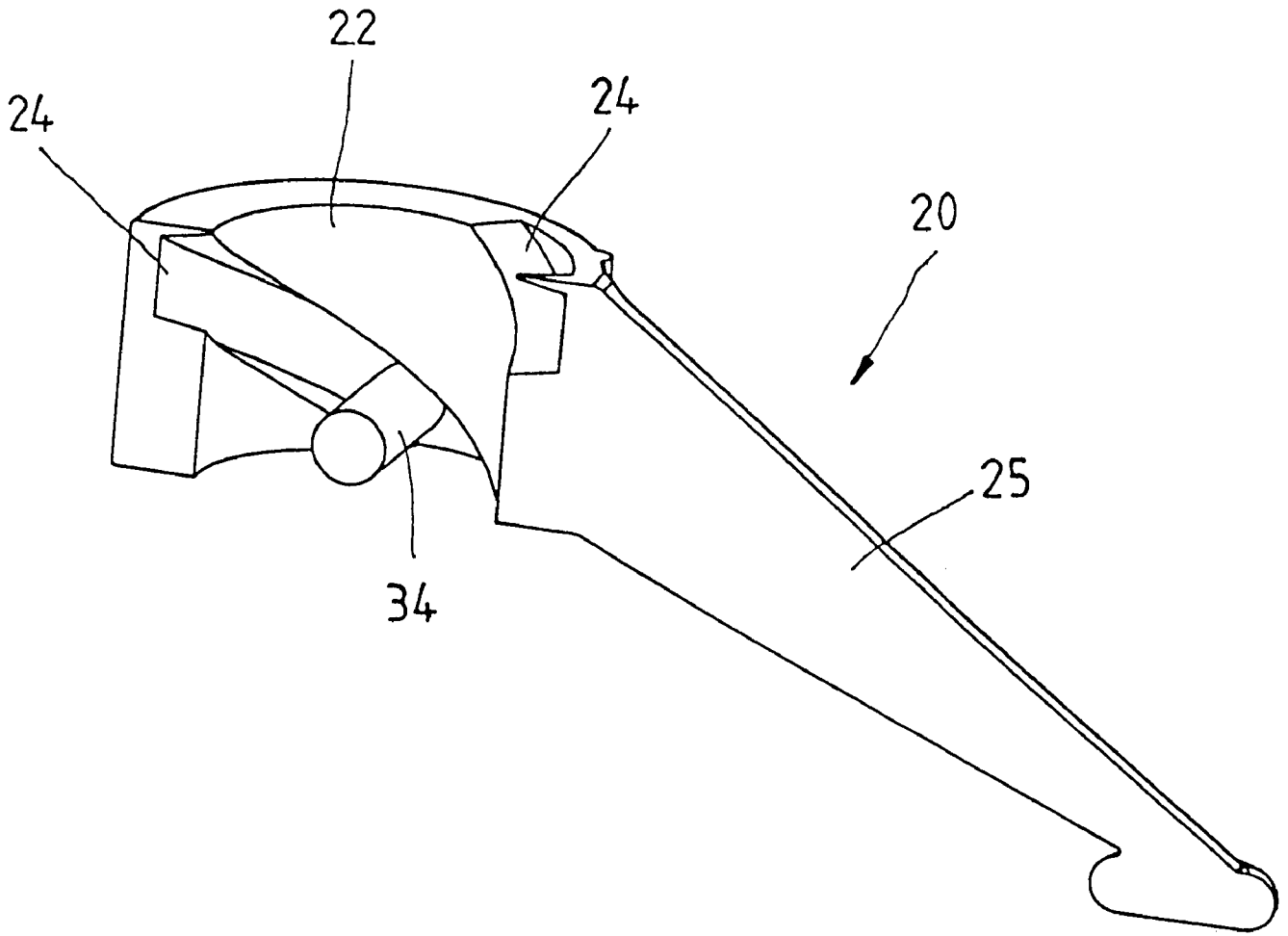
FIG. 5 is a sectional view of the present invention, showing the detail structure of the pin and the guiding slot.

The elastic means 50 are two springs in the embodiment of present invention. The elastic means 50 received in the coupled bushings 40, and with one end against at the coupled bushings 40, the other end against at the cylinder potions 302 of the pressed members 30 respectively. Then the coupled bushings 40 inserted into the holes 12 of the receiving pieces 11 of the main member 10 and the receiving holes 22 of the rotated members 20 respectively. The coupled bushings 40 and the teeth potions 121 of the holes 12 are transition fit or interference fit for fixing the coupled bushings 40 in the main member 10 initially to prevent rotation. Please refer to FIG. 5, the pins 34 received in the guiding slots 24 of the rotated members 20, whereby the rotated members 30 can be driven to rotate when the pressed members 30 displaced.

Finally, disposed the mounts 60 at the inner side of the bottom end of a luggage 90, the rest elements of the present invention disposed at the predetermined location on the outer side of the bottom end of a luggage 90. Four screws (not shown in FIG) coupled the mounts 60 to the posts 14 of the main member 10 and the screw holes 42 of the coupled bushings 40 respectively, to fix all the elements of present invention at the bottom end of the luggage 90.

Figure 6:
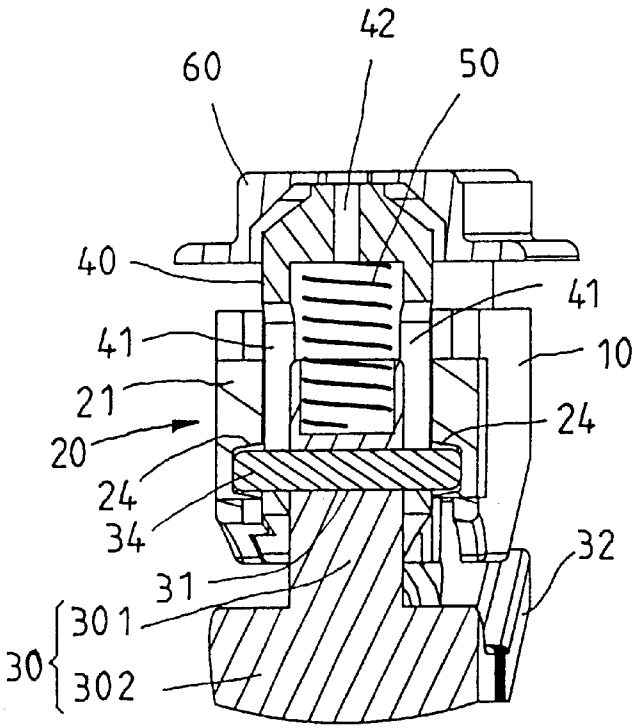
FIG. 6 is a sectional view of the present invention, showing how the pressed member actuated the rotated member to the collapsed position.

Now please refer to FIG. 3 and 6. Initially, the two pressed members 30 of present invention are actuated by the elastic means 50 to position at a unpressed position, in which the pins 34 are closed to the bottom end of the guiding holes 41 of the coupled bushings 40 and corresponding to the bottom end of the guiding slots 24 of the rotated members 20. At this time, the rotated members 20 positioned at collapsed positions, in which the arms 25 of the rotated members 20 oriented to each other.

Figure 7:
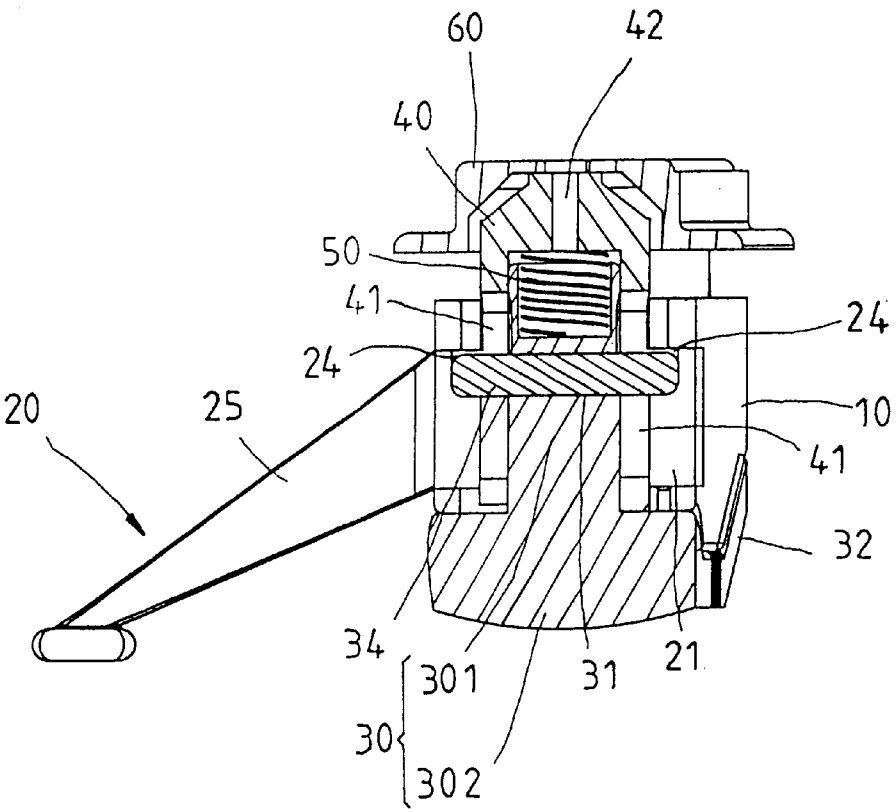
FIG. 7 is a sectional view of the present invention, showing how the pressed member actuated the rotated member to the extended position.

And then, please refer to FIGS. 4 and 7. When a pressure exerted on the pressed members 30 to overcome the spring force of the elastic means 50, the pressed members 30 will move to pressed positions, in which the pins 34 are closed to the top end of the guiding holes 41 of the coupled bushings 40 and corresponding to the top end of the guiding slots 24 of the rotated members 20. At the journey of the pressed members 30 moved from the unpressed position to the pressed position, the rotated members 20 will be driven by the activation of the pins 34 and the guiding slots 24 of the rotated members 20 to turn from the collapsed positions to extended positions, in which the arms 25 of the rotated members 20 oriented to the front side of the luggage. When the pressure vanished or under a specific value, the elastic means 50 will push the pressed members 30 to shift from the pressed positions to unpressed positions, and drove the rotated members 30 to turn back to the collapsed positions as shown in FIGS. 3 and 6.

Figure 8:
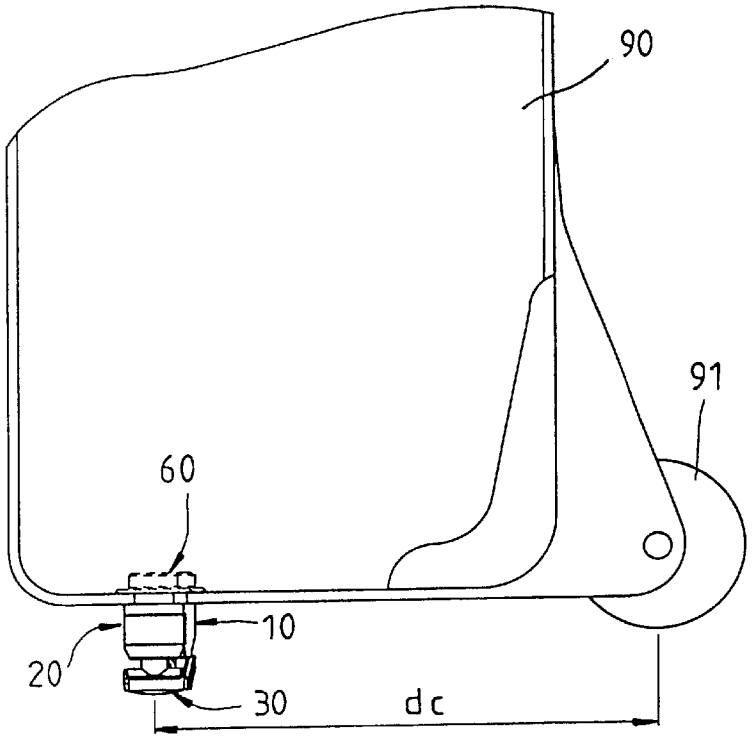
FIG. 8 is a schematic view of a luggage with the present invention, showing the activation of the rotated member when the luggage at the normal state.

Please refer to FIG. 8, when the luggage 90 operated as normal use, which means the luggage 90 would not tip forwards. At this moment, the pressure exerted on the pressed members 30 will not compress the elastic means 50, the pressed members 30 still positioned at the unpressed positions, and the rotated members 20 positioned at collapsed positions. If putting the luggage 90 on the ground, the wheels 91 and the bottom potions 302 of the pressed members 30 will support the luggage 90 stand on the ground. Although the distance ($d_e$) between the wheels 91 and the pressed members 30 is shorter, i.e., the area for supporting the luggage 90 is smaller. But the luggage 90 will not tip forwards because of the center of the gravity of the luggage 90 located at the predetermined range of the original design.

Figure 9:
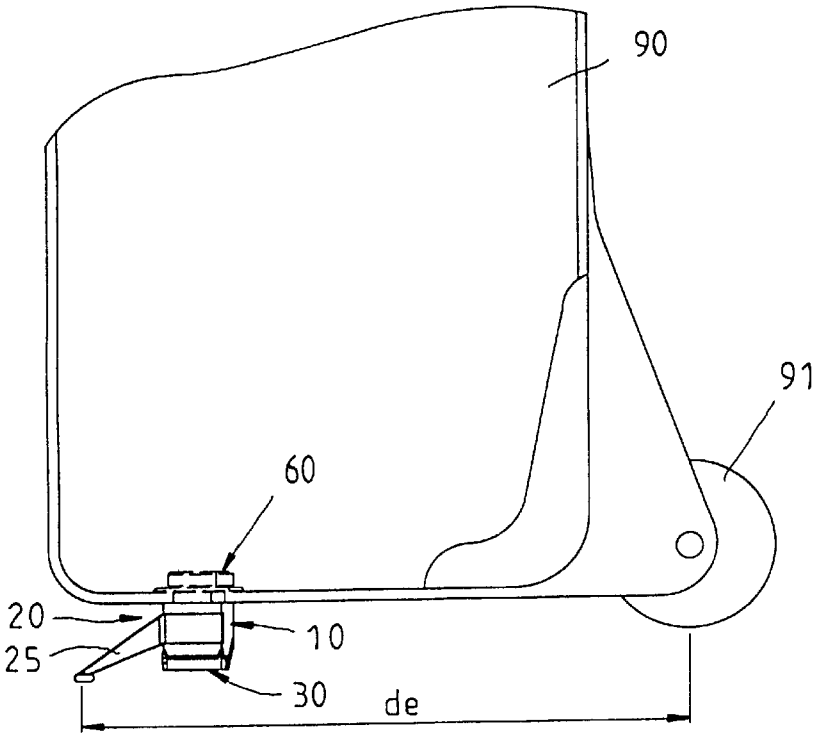
FIG. 9 is a schematic view of a luggage with the present invention, showing the activation of the rotated member when the luggage possibly tipping forwards.
Figure 10:
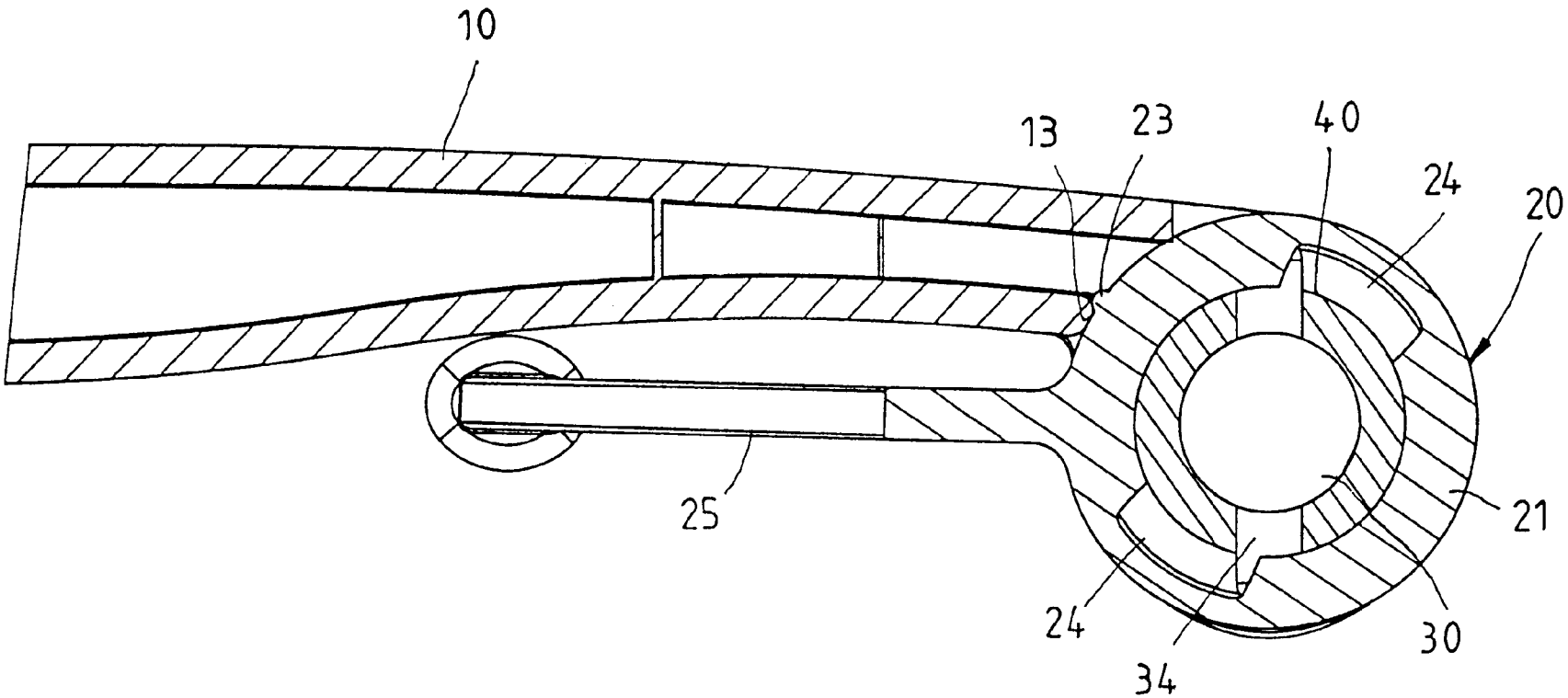
FIG. 10 is a sectional view of the present invention, showing the rotated member is locked by the interference of the rib and the locking rib.

If expensing the volume of the luggage 90 or putting extra articles on the luggage 90, to cause the center of gravity of the luggage 90 shift to the front side of the luggage 90. That will put the luggage 90 in the dangerous of tipping forwards. At this case, the pressure exerted on the pressed members 30 will overcome the elastic means 50 to cause the pressed members 30 shift to the pressed positions and the rotated members 20 are driven to rotate to the extended positions. Please refer to FIG. 9, now the luggage 90 is supported by the wheels 91 and the outer ends of the arms 25 of the rotated members 20. The distance ($d_e$) between the wheels 91 and the outer ends of the arms 25 of the rotated members 20 is enlarged, which cause the area for supporting the luggage 90 increased to prevent tipping the luggage 90 forwards.

If the user is pulling the luggage, in which the pressed members 30 lost the touch with the ground, or the center of gravity of the luggage 90 shift back to normal range, in which the pressure exerted on the pressed members 30 decreased, to cause the luggage 90 will not tip forwards. The elastic means 50 will push the pressed members 30 to the unpressed positions and the rotated members 20 are driven to rotate back to the collapsed positions. Which means, the extendable aid standing of the present invention can detect the distribution of the gravity of the luggage 90 to automatic extend when the luggage 90 is in the dangerous of tipping forwards and to automatic collapse when the dangerous vanished.

An important thing we must describe here, the engagement of the pins 34 of the pressed members 30 and the guiding slots 24 of the rotated members 20 is a mechanism for turning the rotated members 20 between the extended position and the collapsed position when the pressed members 30 displacing between the pressed position and the unpressed position. It is not the only one mechanism to achieve such function. Such as, two engaged bevel surface, a slider engaged on a bevel surface, a slider engaged in a guiding slot (hole), a roller engaged in a guiding slot (hole) or the engagement of a worm gear and a rack etc., which are the variety types of the mechanism to make one element displaced straight to drive another element rotated.

Another specificity will be mentioned hereunder. In some case, we do not want the rotated members 20 extended, such as the luggage is put in the cabin of a truck or an aircraft, the rotated members 20 of the present invention will extend by vibration. At that moment, the luggage will not tip forwards but the extended rotated members 20 will possibly be damaged by unexpected impact or the elastic means will fatigue because of the rotated members 20 continuous extended and collapsed by vibration. The solution for above problem in present invention, we provided the locking ribs 13 and the ribs 23 as described above. When the user didn't want the rotated members 20 extended, he/she can turn the rotated members 20 more inwards to let the ribs 23 of the rotated members 20 shift to the back sides of the locking ribs 13 of the main member 10. Because of the interference of the ribs 23 of the rotated members 20 and the locking ribs 13 of the main member 10, the rotated members 20 is locked and cannot rotate to the extended positions. To release the locking status, user can pull the rotated members outwards, or the pressure exerted on the pressed members 30 exceeded a predetermined value, the ribs 23 of the rotated members 20 will move to the front sides of the locking ribs 13 of the main member 10. After that, the rotated members 20 can turn again to the extended position and collapsed position as described above.

For the interference of the locking ribs 13 and the ribs 23 to lock the rotated members 20 is one of the variety choices of the locking structure. It's easy to be understood, the location and the locking type of the means for locking the rotated members 20 will not limit only in the specification of the present invention described.

Summarizing the features of the extendable aid standing of the present invention, which can detect the distribution of the gravity of the luggage, when there is a dangerous of tipped the luggage forwards, the rotated members of the aid standing will extend automatically to prevent the luggage tipped forwards, and when the dangerous disappeared, the rotated members of the aid standing will collapse automatically.

While only one embodiment of the present invention has been shown and described, it will be understood that various modifications and changes could be made thereunto without departing the spirit and scope of the invention disclosed.

What is claimed is:

1. An extendable aid standing for a luggage, comprising:

a main member adapted to be fixed to a bottom of a luggage;

at least one rotated member having an elongated arm; said rotated member pivotable on said main member so that said rotated member can rotate between a collapsed position, in which said arm of said rotated member is adapted to be oriented to a front side of the luggage, and a extended position, in which said arm of said rotated member is adapted to be oriented to a lateral side of the luggage;

at least one pressed member engaged on a bottom of said main member, wherein said pressed member can displace between a unpressed position, in which said pressed member has been moved outwards from said main member, and a pressed position, in which said pressed member has moved inwards to said main member;

means for driving said rotated member to turn to the collapsed position and the extended position when said pressed member is moved to the unpressed position and the pressed position; and at least one elastic means which has a first end engaged against said main member and a second end engaged against said pressed member to force said pressed member to the unpressed position; wherein when a pressure with a predetermined value is exerted on said pressed member to overcome said elastic means, said pressed member will move to the pressed position and drive said rotated member to turn to the extended position; and wherein when the pressure is smaller than the predetermined value, said elastic means will force said pressed member to move to the unpressed position and said rotated member will be driven to turn to the collapsed position.

2. The extendable aid standing as defined in claim 1, further comprising at least one coupled bushing, which is mounted on said main member; and wherein one end of said pressed member is received in said coupled bushing for displacing vertically at a predetermined limited distance.

3. The extendable aid standing as defined in claim 2, wherein said coupled bushing has two elongated guiding holes and said pressed member has a hole corresponding to said guiding holes of said coupled bushing; wherein a pin is inserted into said guiding holes of said coupled bushing and said hole of said pressed member; and wherein said rotated member has two helical guiding slots and wherein ends of said pin are respectively received in said guiding slots.

4. The extendable aid standing as defined in claim 2, wherein said elastic means is a spring, which is received in said coupled bushing with the first end against said coupled bushing, the second end against said pressed member.

5. The extendable aid standing as defined in claim 2, wherein said main member has two receiving pieces at a lateral end, each of said receiving pieces having a hole and said rotated member having a pivoting portion which has a receiving hole; said guiding slots being provided at an inner surface of said receiving hole of said rotated member; said pivoting portion of said rotated member received in said rotated member between said receiving pieces for free rotation; said coupled bushing received in said holes of said receiving pieces of said main member and said receiving hole of said rotated member.

6. The extendable aid standing as defined in claim 5, wherein the inner surface of said holes of said receiving pieces of said main member have respective teeth portions.

7. The extendable aid standing as defined in claim 1, further comprising at least one mount adapted to be disposed at an inner side of the bottom of the luggage; at least one screw coupled to said main member and said mount for fixing said main member at an outer side of the bottom of the luggage.

8. The extendable aid standing as defined in claim 2, further comprising at least one mount adapted to be disposed at an inner side of the bottom end of the luggage; at least one screw coupled to said main member and said mount and at least one screw coupled said coupled bushing and,said mount for fixing said main member at an outer side of the bottom end of the luggage.

9. The extendable aid standing as defined in claim 1, wherein said rotated member has at least one rib; said main member has at least one locking rib corresponding to said rib of said rotated member, wherein said rotated member is locked by the interference of said rib of said rotated member and said locking rib of said main member.

10. The extendable aid standing as defined in claim 1, further comprising two of each of said rotated member, said pressed and said elastic means; wherein said rotated members pivot at two lateral ends of said main member and the extended positions of said rotated member are said arms of said rotated members generally adapted to be oriented to the front side of the luggage, and the extended positions of said rotated members are said arms of said rotated members generally oriented to each other.

11. The extendable aid standing as defined in claim 10, further comprising a bar having ends connected respectively to said pressed members.

* * * * *